United States Patent [19]

McGuire

[11] 4,175,539

[45] Nov. 27, 1979

[54] FIREPLACE HEATER AND HOME PRESSURIZATION SYSTEM

[75] Inventor: C. James McGuire, Kansas City, Mo.

[73] Assignee: Fireplace Energy Inc., Kansas City, Mo.

[21] Appl. No.: 873,272

[22] Filed: Jan. 30, 1978

[51] Int. Cl.[2] ..... F24B 7/00

[52] U.S. Cl. ..... 126/121; 237/51

[58] Field of Search ..... 126/121, 122, 143; 237/51

[56] References Cited

U.S. PATENT DOCUMENTS

| | | | |
|---|---|---|---|
| 1,681,449 | 8/1928 | Walters | 126/121 |
| 3,901,212 | 8/1975 | Stites | 126/121 |
| 4,008,703 | 2/1977 | Allgood | 126/121 |
| 4,049,196 | 9/1977 | Bergami, Jr. et al. | 237/51 |
| 4,088,114 | 5/1978 | Johnson | 126/121 X |

*Primary Examiner*—William F. O'Dea
*Assistant Examiner*—William E. Tapolcai
*Attorney, Agent, or Firm*—Lowe, Kokjer, Kircher, Wharton & Bowman

[57] ABSTRACT

A blower forces outside air into a heat conductive shell located within a fireplace. A partition separates the shell into inlet and outlet sides, and a baffle causes the air to follow a tortuous path through the inlet side. Heat conductive pipes extending above the shell direct the air between the inlet and outlet sides of the shell. The heated air is distributed within the building through ducts that connect with the outlet side of the shell. The blower forces air to flow through the device at a rate at least as great as the rate of flow through the flue plus the rate of air consumption by the fire.

8 Claims, 3 Drawing Figures

FIREPLACE HEATER AND HOME PRESSURIZATION SYSTEM

BACKGROUND AND SUMMARY OF THE INVENTION

This invention relates in general to heating devices and deals more particularly with a device used to extract and distribute the heat generated in a fireplace.

Although fireplaces continue to enjoy widespread popularity, they are not at all efficient for heating purposes, in large part because of heat losses through the chimney and the failure of the heat from the fireplace to be effectively utilized. Further, the air used for burning and the air lost through the chimney must be replaced by cold air leaking into the building from outside.

The various types of heating devices that have been proposed for use in extracting and distributing the heat from a fireplace have not been entirely satisfactory. Typically, a series of tubes arranged in a complex configuration are installed in the fireplace and air is circulated through the tubes and thereafter distributed within the building. Aside from the costs involved in constructing the complex tube arrangements, the efficiency of heat extraction in devices of this nature is lacking, principally because the circulating air is not thoroughly mixed and uniformly heated. Even though some of the heat from the fireplace is utilized by such devices, they fail to eliminate the problem of cold air leaking into the room to take the place of the air consumed in the burning process and lost through the flue. Moreover, installation of exising devices usually requires significant modification of the fireplace structure and the attendant inconvenience and expense.

It is an important object of the present invention to provide a fireplace heating device which acts to effectively extract heat from a fireplace.

Another object of the invention is to provide a method and device for decreasing the leakage of cold air into buildings due to the burning of a fire in the fireplace. It is significant in this respect that the rate of forced air flow into the building is at least as great as the rate of air lost to the fire and through the chimney.

Yet another object of the invention is to provide a fireplace heating device that effectively mixes the air in order to achieve efficient and uniform heating thereof.

An additional object of the invention is to provide a fireplace heating device that may be quickly and easily installed both in existing and new fireplaces of various sizes and styles without requiring extensive modification of the fireplace structure.

A still further object of the invention is to provide a fireplace heating device of the character described which is simple and economical to construct and which operates reliably with little maintenance requirements.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views.

Figure 1:
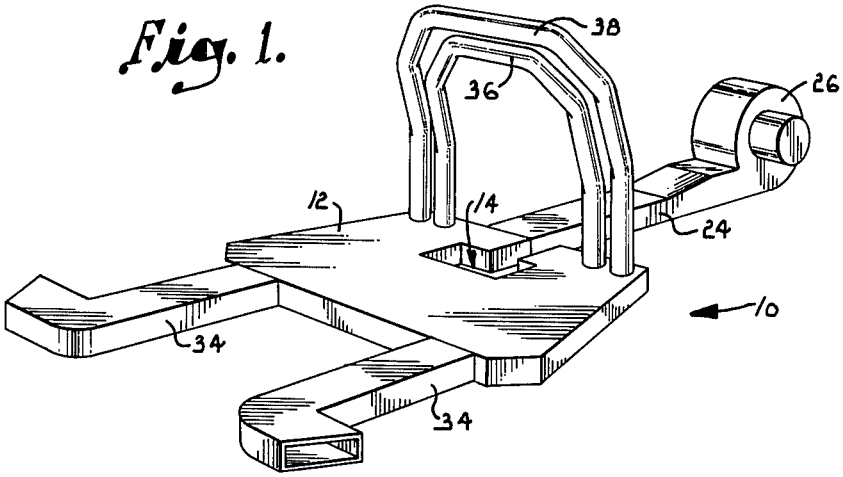
FIG. 1 is a perspective view of a fireplace heating device constructed in accordance with a preferred embodiment of the present invention.

Referring now to the drawing in more detail, numeral 10 generally designates a fireplace heating device constructed according to the present invention. The device 10 has a thin base in the form of a substantially hollow shell 12 which is constructed of metal or another heat conductive material. Shell 12 is impervious to air and has thin, parallel top and bottom panels and thin walls forming its sides, front, and rear. A cutout 14 may be formed in the back portion of the shell to accommodate the clean out trap of the fireplace structure in which the device is to be installed.

Figure 3:
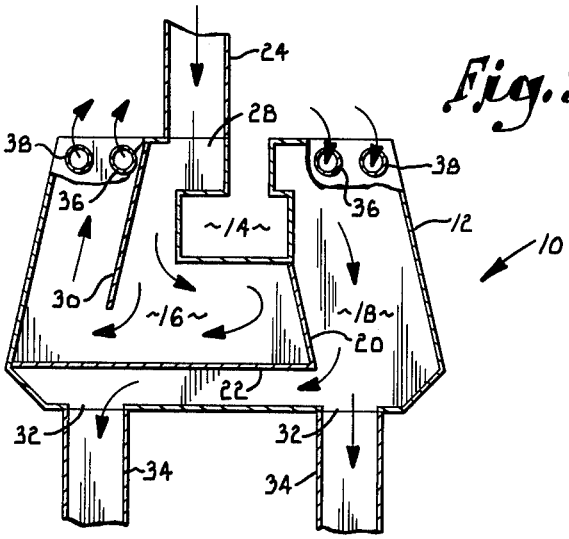
FIG. 3 is a fragmentary top plan view of the fireplace heating device, shown partially in section and with the directional arrows indicating the pattern of air flow through the device.

With reference to FIG. 3 shell 12 is a hollow structure which presents an interior chamber which is divided into an inlet side 16 and an outlet side 18 by a pair of connected partitions 20 and 22. Partition 20 extends generally forwardly from a wall of cutout 14, while partition 22 extends laterally from the end of partition 20 to connection with a side wall of shell 12. A conduit 24 equipped with a conventional blower 26 leads to an inlet 28 located on the inlet side 16 of shell 12. A flat baffle plate 30 located within the inlet side 16 of the shell extends from a location near inlet 28 and terminates in a free edge which is spaced away from partition 22.

The outlet side 18 of the shell has a pair of outlets 32 at the front to which outlet ducts 34 are connected. The ducts 34 may lead to any selected location including rooms remote from the fireplace in order to deliver heated air to the desired area.

The air passes from the inlet side 16 of the shell to the outlet side 18 through a pair of heat conductive pipes 36 and 38 which extend generally above the shell. Each pipe 36 and 38 is bent generally in the shape of an inverted U, with pipe 36 being shorter than pipe 38 and extending parallel thereto. One end of each pipe 36 and 38 connects with the inlet side 16 of the shell, while the opposite end of each pipe connects with the outlet side 18. Consequently, the air must flow through one of the pipes 36 and 38 in order to pass between sides 16 and 18 of the shell.

Figure 2:
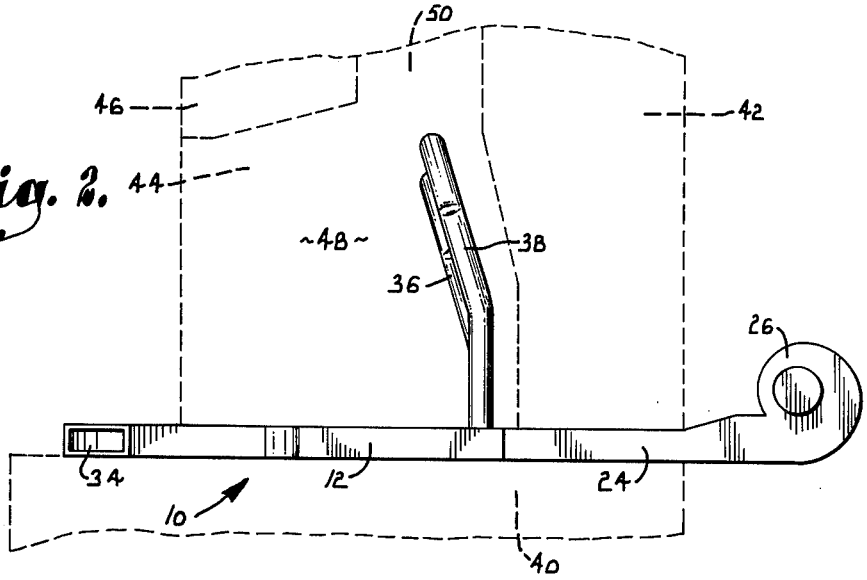
FIG. 2 is a side elevational view showing the device installed in a fireplace, the latter being shown fragmentarily in broken lines.

Device 10 may be installed in a fireplace of virtually any type, including the fireplace shown in broken lines in FIG. 2. The fireplace has a floor 40 and a back 42 which cooperate with opposite sides 44 and an upper front section 46 to present a fireplace cavity 48 in which the fire burns. A flue opening 50 is presented above the cavity to receive smoke and other products of combustion. Shell 12 rests on floor 40 with pipes 36 and 38 located slightly forwardly of the back 42 and near the entrance opening to flue 50. Ducts 34 may extend out the front of cavity 48, while blower 26 is located outside the building so that outside air can be drawn in through its inlet.

In use, blower 26 operates to force outside air through conduit 24 and into shell 12 through inlet 28. The air must flow around baffle 30 due to its location between inlet 28 and the inlet ends of pipes 36 and 38. Consequently, the baffle causes the incoming air to swirl throughout substantially the entirety of inlet side 16 in the long, tortuous path best shown by the directional arrows in FIG. 3. The long, swirling, tortuous path taken by the air causes it to be thoroughly mixed and uniformly heated by the fire burning in the fireplace cavity 48.

After passing through inlet side 16, the air enters pipe 36 and 38 and is further heated therein. Since the upper portions of pipes 36 and 38 are located above shell 12 and in the vicinity of the hot combustion gases entering flue 50, the air is heated to a particularly high temperature in the pipes. The air then flows back into shell 12 on the outlet side 18, where it is further heated by the fire before passing through outlets 32 and into ducts 34 for eventual distribution into the area that is being heated.

In some cases, blower 26 may be eliminated since natural convection currents are sometimes sufficient to draw enough air through the device to result in the desired heating effect. However, it is preferred that blower 26 operate at a rate to force enough air through the device to at least make up for the air lost in the combustion process and through leakage out the flue. Therefore, in the preferred manner of operation of the invention, the rate of air flow effected by blower 26 is equal to or somewhat greater than the rate of air consumed by the fire plus the rate at which air and other gases pass out through the flue as a result of the draft created by the fire. This net increase in the amount of air entering the building maintains a positive pressure in the building (relative to the pressure against the building) and virtually eliminates leakage of the cold air into the building that would otherwise occur due to the need to make up for air lost in the burning process and through leakage out the flue.

The thorough mixing and long flow path that results from the size and arrangement of shell 12 and the provision of baffle 30 causes the air to be heated efficiently and uniformly as it passes through the device. In addition, pipes 36 and 38 direct the air to a particularly hot region within the fireplace without obstructing the flue 50. These features, together with the high rate of flow provided by blower 26, result in efficient heat extraction from the fireplace and a significant reduction in the losses and leakage that would otherwise be present.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A device for extracting heat from a fireplace, said device comprising:

a heat conductive shell adapted for installation in the fireplace and presenting a substantially hollow chamber therein for accommodating a flow of air, said shell having an inlet for directing incoming air into said chamber and an outlet for discharging air therefrom;

partition means in said shell dividing said chamber into an inlet side communicating with said inlet and an outlet side communicating with said outlet;

a heat conductive conduit extending generally above said shell, said conduit having a first end communicating with the inlet side of said chamber and a second end communicating with the outlet side of said chamber, and baffle means disposed in said shell between said inlet and the first end of said conduit, said baffle means acting to direct air throughout the inlet side of said chamber;

whereby air entering said inlet flows from the inlet side of said chamber and through said conduit prior to passing through the outlet side of said chamber and out said outlet.

2. A device as set forth in claim 1, including means for forcing air into said inlet.

3. A device as set forth in claim 1, including a blower communicating with said inlet and operable to effect forced air flow therein.

4. A device as set forth in claim 1, wherein said conduit is arranged generally in the shape of an inverted U.

5. A device as set forth in claim 1, including a second heat conductive conduit extending generally above said shell and having a first end communicating with the inlet side of said chamber and a second end communicating with the outlet side of said chamber.

6. A device as set forth in claim 5, wherein each conduit is arranged generally in the shape of an inverted U.

7. A device as set forth in claim 1, wherein said baffle is arranged and located to effect air flow in a tortuous path through the inlet side of said chamber.

8. A device as set forth in claim 1, wherein the fireplace has a flue outlet, and including a blower operable to effect forced air flow into said inlet at a rate at least as great as the rate of air flow through said flue outlet plus the rate at which air is consumed by the fire.

* * * * *